US007931009B2

(12) United States Patent
Kondo et al.

(10) Patent No.: US 7,931,009 B2
(45) Date of Patent: Apr. 26, 2011

(54) FUEL INJECTOR DESIGNED TO MINIMIZE MECHANICAL STRESS ON FUEL PRESSURE SENSOR INSTALLED THEREIN

(75) Inventors: Jun Kondo, Nagoya (JP); Tooru Taguchi, Handa (JP); Fumiaki Arikawa, Okazaki (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 223 days.

(21) Appl. No.: 12/265,772

(22) Filed: Nov. 6, 2008

(65) Prior Publication Data

US 2009/0118983 A1 May 7, 2009

(30) Foreign Application Priority Data

Nov. 6, 2007 (JP) ..... 2007-289077

(51) Int. Cl.
*F02M 51/00* (2006.01)

(52) U.S. Cl. ..... 123/490; 239/583

(58) Field of Classification Search ..... 123/490, 123/494, 468; 239/583, 584
See application file for complete search history.

(56) References Cited

U.S. PATENT DOCUMENTS

| | | | | |
|---|---|---|---|---|
| 4,438,496 | A | 3/1984 | Ohie | |
| 5,890,653 | A | 4/1999 | Kelly | |
| 6,247,450 | B1 * | 6/2001 | Jiang | 123/446 |
| 6,622,549 | B1 | 9/2003 | Wlodarczyk et al. | |
| 7,216,630 | B2 | 5/2007 | Martin et al. | |
| 2002/0035988 | A1 * | 3/2002 | Nimura et al. | 123/496 |
| 2005/0022793 | A1 * | 2/2005 | Takemoto | 123/480 |
| 2008/0006243 | A1 * | 1/2008 | Fujii | 123/472 |
| 2008/0228374 | A1 | 9/2008 | Ishizuka et al. | |

FOREIGN PATENT DOCUMENTS

| | | |
|---|---|---|
| DE | 101 57 886 | 9/2002 |
| EP | 1 321 660 | 6/2003 |
| JP | S57-005 526 | 1/1982 |
| JP | 2000-265892 | 9/2000 |
| JP | 2006-070800 | 3/2006 |
| JP | 2008-144749 | 6/2008 |

OTHER PUBLICATIONS

Extended European Search Report dated Mar. 3, 2009, issued in corresponding European Application No. 08168395.5-2311.

* cited by examiner

*Primary Examiner* — John T Kwon
(74) *Attorney, Agent, or Firm* — Nixon & Vanderhye PC

(57) ABSTRACT

A fuel injector for an internal combustion engine is provided. The fuel injector is to be installed in a cylinder head of the engine and has a fuel pressure sensor working to measure the pressure of fuel within a injector body. The fuel pressure sensor is installed in a portion of the injector body which is to be located away from the cylinder head of the engine across a portion of the injector body on which a mechanical pressure is exerted by an external member such as a fuel supply pipe or a fuel drain pipe, thereby keeping the fuel pressure sensor free from internal stress, as arising from the mechanical pressure exerted on the injector body, to ensure the accuracy in measuring the pressure of the fuel.

16 Claims, 4 Drawing Sheets

FUEL INJECTOR DESIGNED TO MINIMIZE MECHANICAL STRESS ON FUEL PRESSURE SENSOR INSTALLED THEREIN

CROSS REFERENCE TO RELATED DOCUMENT

The present application claims the benefit of Japanese Patent Application No. 2007-289077 filed on Nov. 6, 2007, the disclosure of which is incorporated herein by reference.

BACKGROUND OF THE INVENTION

1. Technical Field of the Invention

The present invention relates generally to a fuel injector to be mounted in an internal combustion engine to spray fuel thereinto, and more particularly to such a fuel injector which has installed therein a fuel pressure sensor working to measure a change in pressure of the fuel arising from the spraying of the fuel into the engine and which is designed to minimize mechanical stress on the fuel pressure sensor.

2. Background Art

In order to ensure the accuracy in controlling output torque of internal combustion engines and the quantity of exhaust emissions therefrom, it is essential to control a fuel injection mode such as the quantity of fuel to be sprayed from a fuel injector or the injection timing at which the fuel injector starts to spray the fuel. For controlling such a fuel injection mode, there have been proposed techniques for monitoring a change in pressure of the fuel upon spraying thereof from the fuel injector.

Specifically, the time when the pressure of the fuel begins to drop due to the spraying thereof from the fuel injector may be used to determine an actual injection timing at which the fuel has been sprayed actually. The amount of drop in pressure of the fuel arising from the spraying thereof may be used to determine the quantity of fuel actually sprayed from the fuel injector. Such actual observation of the fuel injection mode ensures the desired accuracy in controlling the fuel injection mode.

For instance, in the case where a change in pressure of the fuel arising from the spraying of the fuel from the fuel injector (which will also be referred to as a fuel pressure change below) is measured using a pressure sensor installed directly in a common rail (i.e., a fuel accumulator), it will be somewhat absorbed within the common rail, thus resulting in a decrease in accuracy in determining such a pressure change. In order to alleviate this drawback, Japanese Patent First Publication No. 2000-265892 teaches installation of the pressure sensor in a joint between the common rail and a high-pressure pipe through which the fuel is delivered from the common rail to the fuel injector to measure the fuel pressure change before it is absorbed within the common rail.

The fuel pressure change, as produced at a spray hole of the fuel injector through which the fuel has been sprayed, will, however, surely attenuate within the high-pressure pipe. The use of the pressure sensor installed in the joint between the common rail and the high-pressure pipe, therefore, does not ensure the desired accuracy in determining the fuel pressure change. The inventors have study the installation of the pressure sensor in a portion of the fuel injector which is located downstream of the high-pressure pipe. Such installation, however, has been found to pose the problems, as discussed below.

The pressure sensor is typically made up of a body in which a high-pressure path is formed to supply high-pressure fuel to a spray hole and a valve actuator installed in the body to move a valve to open or close the spray hole. The body is usually subjected to various external pressures as well as internal pressure exerted by the fuel.

For example, when a fuel injector is, as illustrated in FIG. 4, pressed and held by a clamp Kin an internal combustion engine with an injector body 4*x* fit in a mount hole E3 of a cylinder head E2 of the engine, it will cause the pressure F1 to continue to be exerted by the clamp K on the injector body 4*x* in a vertical direction. Additionally, a high-pressure pipe HP which supplies the high-pressure fuel to the fuel injector is joined to an inlet of the injector body 4*x* in misignment therewith, it will cause the pressure F2 to be exerted by the high-pressure pipe HP on the injector body 4*x*.

The exertion of the pressure F1 or F2 from the high-pressure pipe HP will cause internal stress to increase, which acts on a fuel pressure sensor 50*x* installed in the fuel injector, thus resulting in a decrease in accuracy in measuring the pressure of fuel.

SUMMARY OF THE INVENTION

It is therefore a principal object of the invention to avoid the disadvantages of the prior art.

It is another object of the invention to provide a fuel injector for an internal combustion engine which may be employed in automotive diesel common rail injection system and which is so designed to minimize the internal stress of an injector body on a fuel pressure sensor installed in the injector body to ensure the accuracy in measuring the pressure of fuel in the fuel injector.

According to one aspect of the invention, there is provided a fuel injector for an internal combustion engine such as an automotive diesel engines. The fuel injector comprises: (a) an injector body in which a fuel flow path is formed which extends from a fuel inlet to a spray hole, the injector body being to be mounted in a cylinder head of an internal combustion engine; (b) an actuator disposed within the injector body, the actuator working to open the spray hole to spray fuel, as supplied to the fuel flow path through the fuel inlet, to the internal combustion engine; and (c) a fuel pressure sensor working to measure a pressure of the fuel in the injector body and produce an electric signal indicative thereof. The fuel pressure sensor is installed in a first portion of the injector body which is located away from the cylinder head of the internal combustion engine across a second portion of the injector body on which a mechanical pressure is exerted by an external member.

Specifically, the fuel pressure sensor is disposed away from a portion of the injector body where the internal stress will increase when the fuel injector is in use, that is, between a portion of the injector body retained in the cylinder head of the engine and the second portion on which the mechanical pressure is exerted. This keeps the fuel pressure sensor free from the internal stress of the injector body, thus ensuring the accuracy in measuring a change in pressure of the fuel arising from spraying of the fuel from the fuel injector.

In the preferred mode of the invention, the injector body has a fuel inlet port to which a high-pressure pipe that is the external member is to be joined to supply the fuel to the fuel flow path. The fuel inlet port is the second portion of the injector body on which the mechanical pressure is exerted.

The injector body is designed to have a surface with which a clamp is to be placed in abutment to exert pressure on the injector body to mount the injector body in a mount hole formed in the cylinder head. The clamp is the external member. The surface of the injector body is the second portion of the injector body on which the mechanical pressure that is the pressure exerted by the claim acts.

The injector body has a fuel outlet port to which a drain pipe that may alternatively be the external member is to be joined to drain an excess of the fuel from the injector body. In this case, the fuel outlet is the second portion of the injector body on which the mechanical pressure is exerted.

The injector body is so designed as to be mounted in a mount hole formed in the cylinder head of the internal combustion engine. The first portion of the injector body in which the fuel pressure sensor is installed is to be located outside the mount hole.

The external member (e.g., the clamp, the high-pressure pipe, or the drain pipe) may be located either inside or outside the cylinder head of the engine. Similarly, the fuel pressure sensor may be disposed either inside or outside the portion of the injector body which is retained in the cylinder head.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
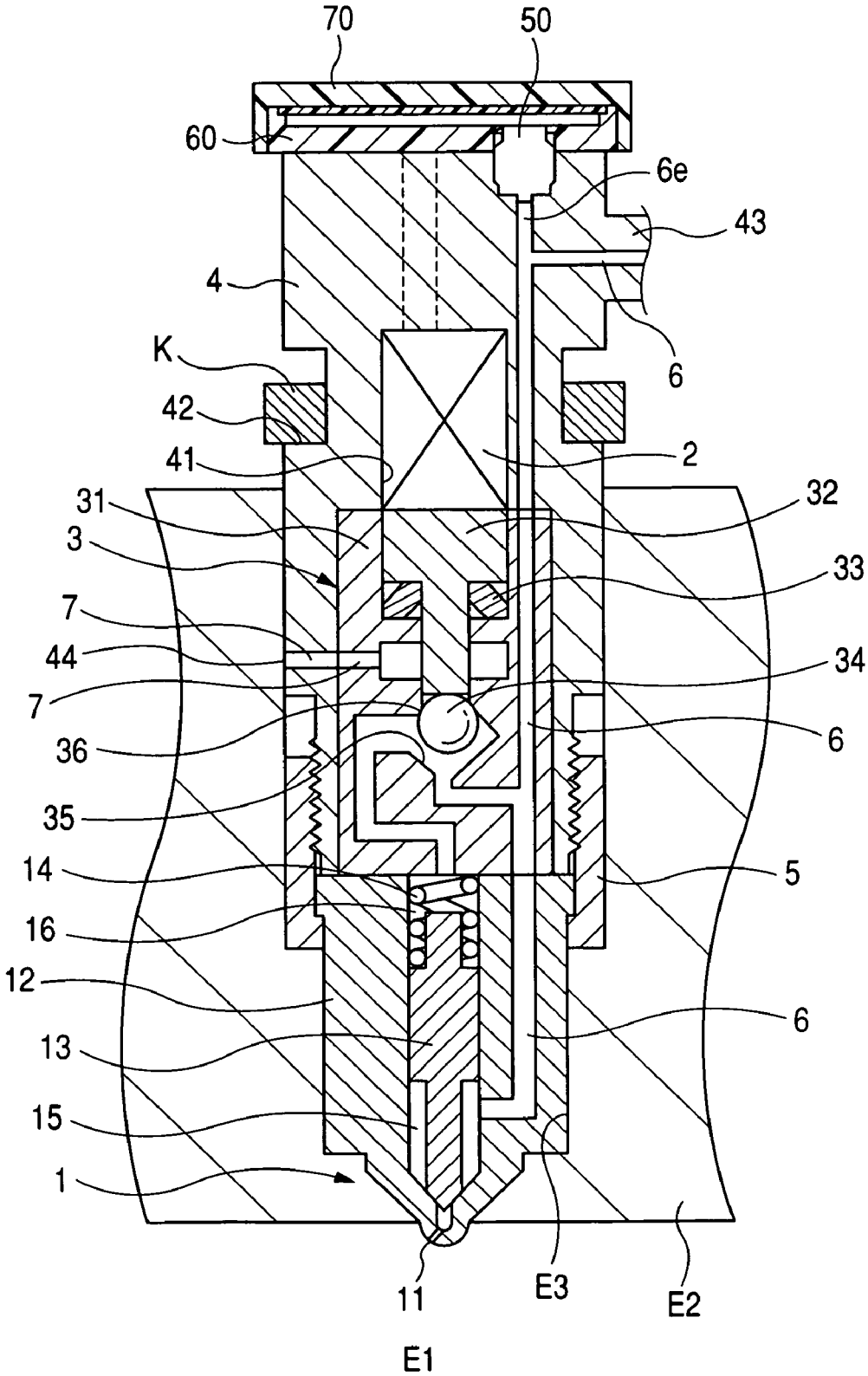
FIG. 1 is a longitudinal sectional view which shows an internal structure of a fuel injector according to the first embodiment of the invention.
Figure 2:
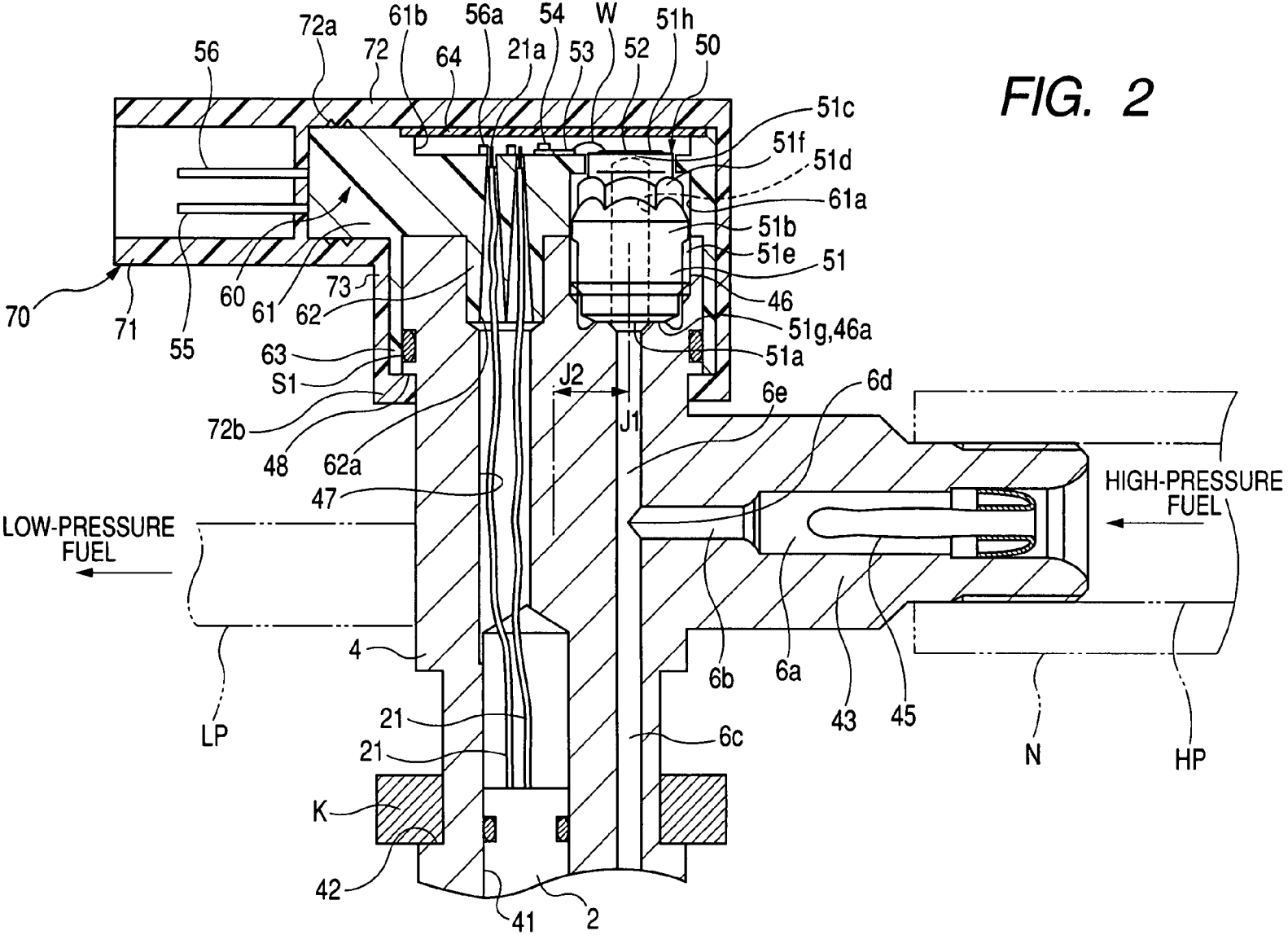
FIG. 2 is a partially enlarged sectional view of FIG. 1.

Referring to the drawings, wherein like reference numbers refer to like parts in several views, particularly to FIGS. 1 and 2, there is shown a fuel injector according to the first embodiment of the invention which will be referred to herein as being used in, for example, automotive common rail fuel injection Systems for diesel engines.

The fuel injector works to inject the fuel, as stored in a common rail (not shown) at controlled high pressures, into a combustion chamber E1 in a cylinder of an internal combustion diesel engine. The fuel injector is equipped with a nozzle 1 from which the fuel is sprayed, a piezoelectric actuator 2 which serves as an open/close mechanism and expands when electrically charged and contracts when discharged, and a back-pressure control mechanism 3 which is operated by the piezoelectric actuator 2 to control the back pressure acting on the nozzle 1.

The nozzle 1 is made up of a nozzle body 12 in which a spray hole(s) 11 is formed, a needle 13 which is moved into or out of abutment with an inner seat of the nozzle body 12 to close or open the spray hole 11, and a spring 14 urging the needle 13 in a valve-closing direction to close the spray hole 11.

The piezoelectric actuator 2 includes a piezo stack made up of a plurality of piezoelectric devices. The piezoelectric actuator 2 is a capacitive load which expands when electrically charged and contracts when discharged and functions as an actuator to move the needle 13.

The back-pressure control mechanism 3 includes a valve body 31 within which a piston 32, a disc spring 33, and a ball valve 34 are disposed. The piston 32 is moved following the stroke of the piezoelectric actuator 2. The disc spring 33 urges the piston 32 into constant abutment with the piezoelectric actuator 2. The ball valve 34 is moved by the piston 32. The valve body 31 is illustrated as being made by a one-piece member, but is actually formed by a plurality of blocks.

The fuel injector also includes a cylindrical injector body 4 in which a cylindrical mount chamber 41 is formed which extends along a longitudinal center line of the fuel injector. The mount chamber 41 has an inner shoulder to define a small-diameter housing (i.e., an upper housing, as viewed in FIG. 1) in which the piezoelectric actuator 2 is mounted and a large-diameter housing (i.e., a lower housings as viewed in FIG. 1) in which the back-pressure control mechanism 3 is mounted. A hollow cylindrical retainer 5 is fit in the injector body 4 in a screw fashion to retain the nozzle 1 within the head of the injector body 4.

The nozzle body 12; the injector body 4, and the valve body 31 have formed therein a high-pressure path 6 through which the fuel is delivered at a controlled high pressure from the common rail to the spray hole 11. The injector body 4 and the valve body 31 have also formed therein a low-pressure path 7 which connects with a fuel tank (not shown). The nozzle body 12, the injector body 4, and the valve body 31 are made of metallic material and to be fit in a mount hole E3 formed in a cylinder head E2 of the engine. The injector body 4 has an outer shoulder 42 with which an end of a clamp K is to engage for securing the fuel injector in the mount hole E3 tightly. Specifically, installation of the fuel injector in the mount hole E3 is achieved by fastening the other end of the clamp K to the cylinder head E2 through a bolt to press the outer shoulder 42 into the mount hole E3.

Between the outer periphery of a top portion of the needle 13 close to the spray hole 11 and the inner periphery of the nozzle body 12, a high-pressure chamber 15 is formed which establishes a fluid communication between the high-pressure path 6 and the spray hole 11 when the needle 13 is lifted up in a valve-opening direction. The high-pressure chamber 15 is supplied with the high-pressure fuel through the high-pressure path 6 at all times. A back-pressure chamber 16 is formed by one of ends of the needle 13 which is opposite the spray hole 11. The spring 14 is disposed within the back-pressure chamber 16 to urge the needle 13 in the valve-closing direction.

The valve body 31 has formed therein a high-pressure seat 35 exposed to a fluid path extending between the high-pressure path 6 and the back-pressure chamber 16. The valve body 31 has also formed therein a low-pressure seat 36 exposed to a path extending between the low-pressure path 7 and the back-pressure chamber 16 in the nozzle 1. The low-pressure seat 36 faces the high-pressure seat 35 to define a valve chamber within which the ball valve 34 is disposed.

The injector body 4 has, as shown in FIGS. 1 and 2, a high-pressure port (i.e., a fuel inlet) 43 to which a high-pressure pipe HP is to be connected and a low-pressure port (i.e., a fuel outlet) 44 to which a low-pressure pipe LP (i.e., a drain pipe) is to be connected. The connections of the high-pressure pipe HP and the low-pressure pipe LP to the high-pressure port 43 and the low-pressure port 44 are achieved by fastening nuts N (only one is shown for the brevity of illustration). The low-pressure port 44 may be located either below or above the clamp K, in other words, closer to or farther from the spray hole 11 than the claim K, as illustrated in FIG. 1 or 2. Similarly, the high-pressure port 43 may be located either below or above the clamp K.

The fuel injector of this embodiment is so designed that the fuel is delivered from the common rail to the high-pressure port 43 through the high-pressure pipe HP, in other words, the fuel enters the cylindrical injector body 4 at an outer circumferential wall thereof. The fuel, as having entered the fuel injector, passes through portions 6*a* and 6*b* of the high-pressure path 6 within the high-pressure port 43, as clearly illustrated in FIG. 2, which extend perpendicular to the axis (i.e., the longitudinal direction) of the fuel injector, flows through a portion 6*c* of the high-pressure path 6 extending parallel to the axis of the fuel injector, and then enters the high-pressure chamber 15 and the back-pressure chamber 16.

The high-pressure paths 6*c* and 6*b* that are portions of the high-pressure path 6 intersect with each other at substantially right angles to in the form of an elbow. The high-pressure path 6 also includes a branch path 6*e* which extends from a joint or intersection 6*d* between the high-pressure paths 6*c* and 6*b* away from the spray hole 11 in parallel to the longitudinal axis of the injector body 4. The branch path 6*e* leads to a fuel pressure sensor 50, as will be described below in detail.

The high-pressure path 6*a* is greater in diameter than the high-pressure path 6*b* within the high-pressure port 43. A filter 45 is, as can be seen in FIG. 2, disposed inside the high-pressure path 6*a* to trap foreign matters contained in the fuel supplied from the common rail.

When the piezoelectric actuator 2 is in a contracted state, the valve 34 is, as illustrated in FIG. 1, urged into abutment with the low-pressure seat 36 to establish the fluid communication between the back-pressure chamber 16 and the high-pressure path 6, so that the high-pressure fuel is supplied to the back-pressure chamber 16. The pressure of the fuel in the back-pressure chamber 16 and the elastic pressure, as produced by the spring 14 act on the needle 13 to urge it in the valve-closing direction to close the spray hole 11.

Alternatively, when the piezoelectric actuator 2 is in an expanded state, the valve 34 is pushed into abutment with the high-pressure seat 35 to establish the fluid communication between the back-pressure chamber 16 and the low-pressure path 7, so that the pressure in the back-pressure chamber 16 drops, thereby causing the needle 13 to be urged by the pressure of fuel in the high-pressure chamber 15 in the valve-opening direction to open the spray hole 11 to spray the fuel into the combustion chamber E1 of the engine.

The spraying of the fuel from the spray hole 11 will result in a variation in pressure of the fuel in the high-pressure path 6. The fuel pressure sensor 50 installed in the injector body 4 works to measure such a fuel pressure variation. An ECU (electronic control unit) of a fuel injection system (not shown) analyses the waveform of the output from the fuel pressure sensor 50 and finds the time when the pressure of the fuel began to drop due to the spraying of the fuel from the spray hole 11 to determine the injection timing of the fuel injector. The ECU also analyzes the waveform of the output and finds the time when the pressure of the fuel began to rise due to the termination of the spraying of the fuel from the spray hole 11 to calculate the end of the injection duration for which the fuel injector is kept opened. The ECU further calculates the amount of drop in pressure of the fuel to determine the quantity of fuel actually sprayed from the fuel injector.

The structure of the fuel pressure sensor 50 and the installation thereof in the injector body 4 will be described below.

The fuel pressure sensor 50 is equipped with a stem 51 working as a pressure deformable member which is sensitive to the pressure of fuel in the branch path 6*e* to deform elastically and a strain gauge 52 working to convert the elastic deformation or distortion of the stem 51 into an electric signal. The stem 51 is made of metal which needs to have the mechanical strength great enough to withstand the pressure of the fuel in the branch path 6*e* and a coefficient of thermal expansion low enough to keep adverse effects on the operation of the strain gauge 52 within an allowable range. For example, the stem 51 is preferably formed by machining (cutting) or cold-forging a material made of a mixture of main components of Fe, Ni, and Co or Fe and Ni and additives of Ti, Nb, and Al or Ti and Nb as precipitation strengthening materials.

The stem 51 includes a hollow cylindrical body 51*b*, as illustrated in FIG. 2, and a circular plate-made diaphragm 51*c*. The cylindrical body 51*b* has formed in an end thereof a fuel inlet 51*a* into which the fuel enters. The diaphragm 51*c* closes the other end of the cylindrical body 51*b*, The pressure of the fuel entering the cylindrical body 51*b* at the inlet 51*a* is exerted on the diaphragm 51*c* and an inner wall 51*d* of the cylindrical body 51*b*, so that the stem 51 is deformed elastically as a whole.

The cylindrical body 51*b* and the diaphragm 51*c* are axial-symmetrical with respect to a longitudinal center line J1 (i.e., an axis), as indicated by a dashed-dotted line in FIG. 2, of the fuel pressure sensor 50 (i.e., the stem 51), so that the stem 51 will deform axisymmetrically when subjected to the pressure of the fuel. The longitudinal center line J1 of the stern 51 is offset from the longitudinal center line J2 of the injector body 4 in parallel thereto. In other words, the fuel pressure sensor 50 is placed in misalignment with the injector body 4 in the longitudinal direction of the fuel injector.

The injector body 4 has formed in the end (i.e., an upper end, as viewed in FIG. 2) thereof a recess or mount chamber 46 in which the cylindrical body 51*b* of the stem 51 is mounted. The mount chamber 46 has an internal thread formed on an inner peripheral wall thereof. The cylindrical body 1*b* has an external thread 51*e* formed on an outer peripheral wall thereof. The installation of the stem 51 in the injector body 4 is achieved by inserting the stem 51 into the mount chamber 46 from outside the injector body 4 along the longitudinal center line J2 and fastening a chamfered surface 51*f* formed on the outer periphery of the cylindrical body 51*b* using a tool such as a spanner to engage the external thread 51*e* of the cylindrical body 51*b* with the internal thread of the mount chamber 46.

The bottom of the mount chamber 46 of the injector body 4 has an annular sealing surface 46*a* extending around the circumference of the open end of the inlet 51*a*. Similarly, the cylindrical body 51*b* of the stem 51 has formed on the top end (i.e., the lower end, as viewed in FIG. 2) thereof facing the spray hole 11 an annular sealing surface 51*g* which is to be placed in close abutment with the sealing surface 46*a* when the fuel pressure sensor 50 is fastened in the mount chamber 46 tightly. Specifically, the tight engagement of the external thread 51*e* of the cylindrical body 51*b* with the internal thread of the mount chamber 46 urges the sealing surface 51*g* of the cylindrical body 51*b* into constant abutment with the sealing surface 46*a* of the mount chamber 46 to create a hermetical metal-touch-seal between the injector body 4 and the stern 51. This avoids the leakage of the fuel from the branch path 6*e* to outside the injector body 4 through a contact between the injector body 4 and the stem 51. Each of the sealing surfaces 46*a* and 51*g* extends perpendicular to the longitudinal center line J1 of the stem 51.

The strain gauge 52 is affixed to a mount surface 51*h* of the diaphragm 51*c* through an insulating film (not shown). The mount surface 51*h* is one of opposed outer major surfaces of the diaphragm 51*c* which is far from the inlet 51*a*. When the pressure of the fuel enters the cylindrical body 51*b*, so that the stem 51 elastically expands, the diaphragm 51*c* will deform.

This causes the strain gauge 52 to produce an electrical output as a function of the amount of deformation of the diaphragm 51*c*. The diaphragm 51*c* and a portion of the cylindrical body 51*b* are located outside the mount chamber 46. The diaphragm 51*c* is disposed on the cylindrical body 51*b* so as to extend perpendicular to the longitudinal center line J1 of the stem 51.

An insulating substrate 53 is placed flush with the mount surface 51*h*. On the insulating substrate 53, circuit component parts 54 are fabricated which constitute a voltage applying circuit and an amplifier which are electrically connected to the strain gauge 52 through wires W using wire bonding techniques. The strain gauge 52 forms a bridge circuit along with resistors (not shown), The voltage applying circuit works to apply the voltage to the strain gauge 52. This causes the bridge circuit to change a resistance value thereof as a function of the degree of deformation of the diaphragm 51*c*, thus resulting in a change in output voltage from the bridge circuit. Specifically, the bridge circuit produces the voltage as indicating the pressure of the fuel in the branch path 6*e*. The amplifier works to amplify the output from the strain gauge 52 (i.e., the voltage produced by the bridge circuit) and outputs it from one of four sensor terminals 55: one being a sensor output terminal, one being a voltage terminal, one being a circuit control terminal, and one being a ground terminal. Drive terminals 56 extend parallel to the sensor terminal s55 in connection with positive and negative power supply leads 21 extending from the piezoelectric actuator 2. The drive terminals 56 serve to supply electric power (e.g., 160 to 170V) to the piezoelectric actuator 2 to charge it.

The sensor terminals 55 and the drive terminals 56 are united by a mold 60 made of resin (i.e., heat insulator material). The resin mold 60 is made up of a body 61, a boss 62, and a hollow cylindrical wall 63. The body 61 is placed on one of the ends of the cylindrical injector body 4 which is far from the spray hole 11. The boss 62 extends or projects downwardly, as viewed in FIG. 2, from the body 61 toward the spray hole 11. The cylindrical wall 62 extends from the body 61 toward the spray hole 11 around the boss 62.

The body 61 has formed therein a hole 61*a* within which the fuel pressure sensor 50 is disposed. The mount surface 51*h* of the diaphragm 51*c* on which the strain gauge 52 is secured is exposed to an open end of the hole 61*a* far from the spray hole 11. The insulating substrate 53 is affixed to one of opposed surfaces of the body 61 which is far from the spray hole 11, so that the mount surface 51*h* of the diaphragm 51*c* lies in the same plane as the insulating substrate 53. The strain gauge 52 on the mount surface 51*h*, the circuit component parts 54, and the insulating substrate 53 are disposed within a mount recess 61*b* formed in the surface of the body 61. The mount recess 61*b* is closed by a resinous cover 64.

The boss 62 of the resin mold 60 is fitted in a lead wire hole 47 which is formed in the injector body 4 and through which the power supply leads 21 pass, thereby positioning the resin mold 60 radially of the injector body 4. The boss 62 has formed therein a through hole 62*a* which extends substantially parallel to the longitudinal center line J2. Ends of the lead wires 21 and ends 56*a* of the drive terminals 56 are exposed outside the surface of the body 61 which is far from the spray hole 11. Each of the lead wires 21 is welded electrically to one of the ends 56*a* of the drive terminals 56.

The hollow cylindrical wall 63 extends along the outer periphery of the injector body 4. Specifically, the cylindrical wall 63 is fit on the circumference of the injector body 4. An O-ring S1 is fit in an annular groove formed in the circumference of the injector body 4 to establish a hermetical seal between the injector body 4 and the cylindrical wall 63, which avoids the intrusion of water from outside the injector body 4 to the strain gauge 52 and the lead wires 21 through a contact between the injector body 4 and the resin mold 60. When adhered to the lead wires 21 drops of water may flow along the lead wires 21 to wet the drive terminals 56 and the circuit component parts 54 undesirably.

The sensor terminals 55 and the drive terminals 56 disposed within the resin mold 60 are retained firmly inside a resinous connector housing 70. Specifically, the sensor terminals 55, the drive terminals 56, and the connector housing 70 constitute a sensor electric connector assembly. The connector housing 70 includes a hollow cylindrical extension 71 for establishing a mechanical connection with external lead wires (not shown), a hollow body 72 in which the resin mold 60 is retained, and a hollow cylindrical wall 73 which extends toward the spray hole 11 and is fit on the cylindrical wall 63 of the resin mold 60.

The body 72 and the cylindrical wall 73 are contoured as a whole to conform with the contours of the body 61, the cover 64, and the cylindrical wall 63 of the resin mold 60. The connector housing 70 and the resin mold 60 are assembled together using molding techniques. Specifically, the body 72 has annular ridges 72*a* which create hermetical seals between the connector housing 70 and the resin mold 60 when the connector housing 70 is molded so as to cover the resin mold 60, as will be described later in detail. The hermetical seals avoid the intrusion of water from outside the injector body 4 into the connector housing 70 through a contact between the inner wall of the cylindrical wall 73 of the connector housing 70 and the outer wall of the cylindrical wall 73 of the resin mold 60 to wet the sensor terminals 55 and the drive terminals 56 exposed inside the cylindrical extension 71 undesirably.

The cylindrical wall 73 of the connector housing 70 has an annular claw 72*b* which establishes a snap fit on a shoulder 48 formed on the injector body 4, thereby securing the orientation of an assembly of the connector housing 70 and the resin mold 60 to the longitudinal center line J1 of the stem 50.

A sequence of steps of installing the fuel pressure sensor 50 and the connector housing 70 in and on the injector body 4 will be described below.

First, the piezoelectric actuator 2 and the fuel pressure sensor 50 are installed in the mount chambers 41 and 46 of the injector body 4, respectively. The installation of the fuel pressure sensor 50 is, as already described above, achieved by inserting the fuel pressure sensor 50 into the mount chamber 46 parallel to the longitudinal center line J2 of the injector body 4, and turning the chamfered surface 51*f* using the clamp K to press the sealing surface 51*g* of the stem 51 against the sealing surface 46*a* of the mount chamber 46 of the injector body 4 to establish the metal-touch-seal between the injector body 4 and the stem 51. The sensor terminals 55 and the drive terminals 56 which are united by the resin mold 60 is prepared. The insulating substrate 53 on which the circuit component parts 54 are fabricated is mounted on the resin mold 60.

Next, the resin mold 60 in and on which the sensor output terminal 55, the drive terminals 56, and the insulating substrate 53 are mounted is fitted in the injector body 4 in which the piezoelectric actuator 2 and the fuel pressure sensor 50 are already installed. Specifically, the boss 60 of the resin mold 60 is fitted into the lead wire hole 47. Simultaneously, the lead wires 21 are inserted into the through hole 62*a*, and the fuel pressure sensor 50 is fitted into the hole 61*a* of the body 61 of the resin mold 60, so that the mount surface 51*h* of the diaphragm 51*c* lies flush with the insulating substrate 53.

Subsequently, the strain gauge 52 placed on the mount surface 51*h* is joined electrically to lands on the insulating substrate 53 through the wires W using the wire bonding techniques. Each of the ends 21*a* of the lead wires 21 exposed inside the mount recess 61*b* is welded to one of the ends 56*a* of the drive terminals 56.

The cover 54 is welded or glued to the resin mold 60 to cover the mount recess 61*b* hermetically. Finally, the connector housing 70 is formed by resin as to cover the resin mold 60. Specifically, resin is thermally melted over the resin mold 60 to mold the connector housing 70 so that the annular claw 72*b* is fit on the shoulder 48 of the injector body 48. During such a molding process, the annular ridges 72*a* formed on the resin mold 60 melt to create the hermetical seals between the connector housing 70 and the resin mold 60. This completes the installation of the fuel pressure sensor 50 and the connector housing 70 in and on the injector body 4.

In the complete assembly of the fuel injectors the resin mold 60 is located between the injector body 4 and the circuit component parts 54 and also between the stem 51 and the circuit component parts 54. In use, the fuel injector is disposed in the mount hole E3 of the cylinder head E2 of the engine, so that it is exposed to a high-temperature of, for example, 140° C., which leads to a concern about the thermal breakage of the circuit component parts 54.

In order to avoid the above problem, the fuel injector of this embodiment is designed to have the resin mold 60 serving as a thermal shield to shield the circuit component parts 54 and the insulating substrate 53 thermally from the metallic injector body 4 and the metallic stem 51, thereby protecting the circuit component parts 54 from the heat transmitted from the combustion chamber E1 of the engine.

The structure of the fuel injector of this embodiment offers the following advantages.

1) The injector body 4 undergoes the mechanical pressure, as transmitted from the clamp K, the high-pressure pipe HP, or the low-pressure pipe LP. Specifically, the mechanical pressure is exerted by the clamp K on the shoulder 42 of the injector body 4 to push it into the mount hole E3 of the cylinder head E2. If the high-pressure pipe HP is joined to the high-pressure port 43 in misalignment therewith, it will cause the mechanical pressure, as created to bring the high-pressure pipe HP into alignment with the high-pressure port 43, to be exerted on the high-pressure port 43. The same is true for the low-pressure pipe LP. In addition, mechanical vibrations are usually transmitted from the engine to the injector body 4 through the clamp K and the high- and low-pressure ports 43 and 44. Note that the low-pressure port 44 is illustrated in FIG. 1 as being inside the cylinder head E2, however in practice, an outlet port to which the low-pressure pipe LP is joined directly is located outside the cylinder head E2. The exertion of such pressure on the injector body 4 will cause the internal stress to increase between a portion of the injector body 4 retained in the cylinder head E2 and the shoulder 42, the high-pressure port 43, or the low-pressure port 44 on which the pressure acts directly, which is, in turn, exerted on the fuel pressure sensor 50 undesirably, thus resulting in a decrease in accuracy in determining the pressure of the fuel. In order to alleviate this problem, the fuel pressure sensor 50 is mounted at a location opposite the cylinder head E2 across the shoulder 42, the high-pressure port 43, and the low-pressure port 44, in other words, the fuel pressure sensor 50 is away from where the internal stress increases (i.e., between the portion of the injector body 4 retained within the cylinder head E2 and the shoulder 42, the high-pressure port 43, or the low-pressure port 44), thereby minimizing the adverse effects of the internal stress on the fuel pressure sensor 50.

2) If the fuel pressure sensor 50 is installed in a portion of the injector body 4 which is located inside the mount hole E3 of the cylinder head E2, it may cause the portion to be subjected to the pressure exerted by the cylinder head E2, so that the internal stress thereof rises. The fuel injector of this embodiment has the fuel pressure sensor 50 installed outside the mount hole E3 of the cylinder head E, thus keeping the fuel pressure sensor 50 free from the internal stress of the injector body 4 and ensuring the accuracy in measuring the pressure of the fuel through the fuel pressure sensor 50.

3) The fuel pressure sensor 50 is made up of the stain gauge 52 and the stem 51. The stem 51 is fit in the injector body 4. The strain gauge 52 is affixed to the stem 51. The stem 51 is made independently from the injector body 4, thus permitting a loss of propagation of internal stress in the injector body 4 resulting from thermal expansion/contraction to the stem 51 to be increased. Specifically, the stem 51 is made to be separate from the injector body 4, thus reducing the adverse effects of the distortion of the injector body 4 on the stem 51 on which the strain gauge 52 is disposed as compared with when the strain gauge 52 is attached directly to the injector body 4. This results in improved accuracy in measuring the pressure of the fuel arising from the spraying of the fuel into the engine.

4) The stem 51 is axisymmetrical in configuration thereof, thus resulting in axisymmetrical deformation thereof when the diaphragm 51*c* is subjected to the pressure of the fuel, thus causing the diaphragm 51*c* to deform elastically as a function of the pressure of the fuel exerted thereon accurately. This ensures the accuracy in determining the pressure of the fuel.

Figure 4:
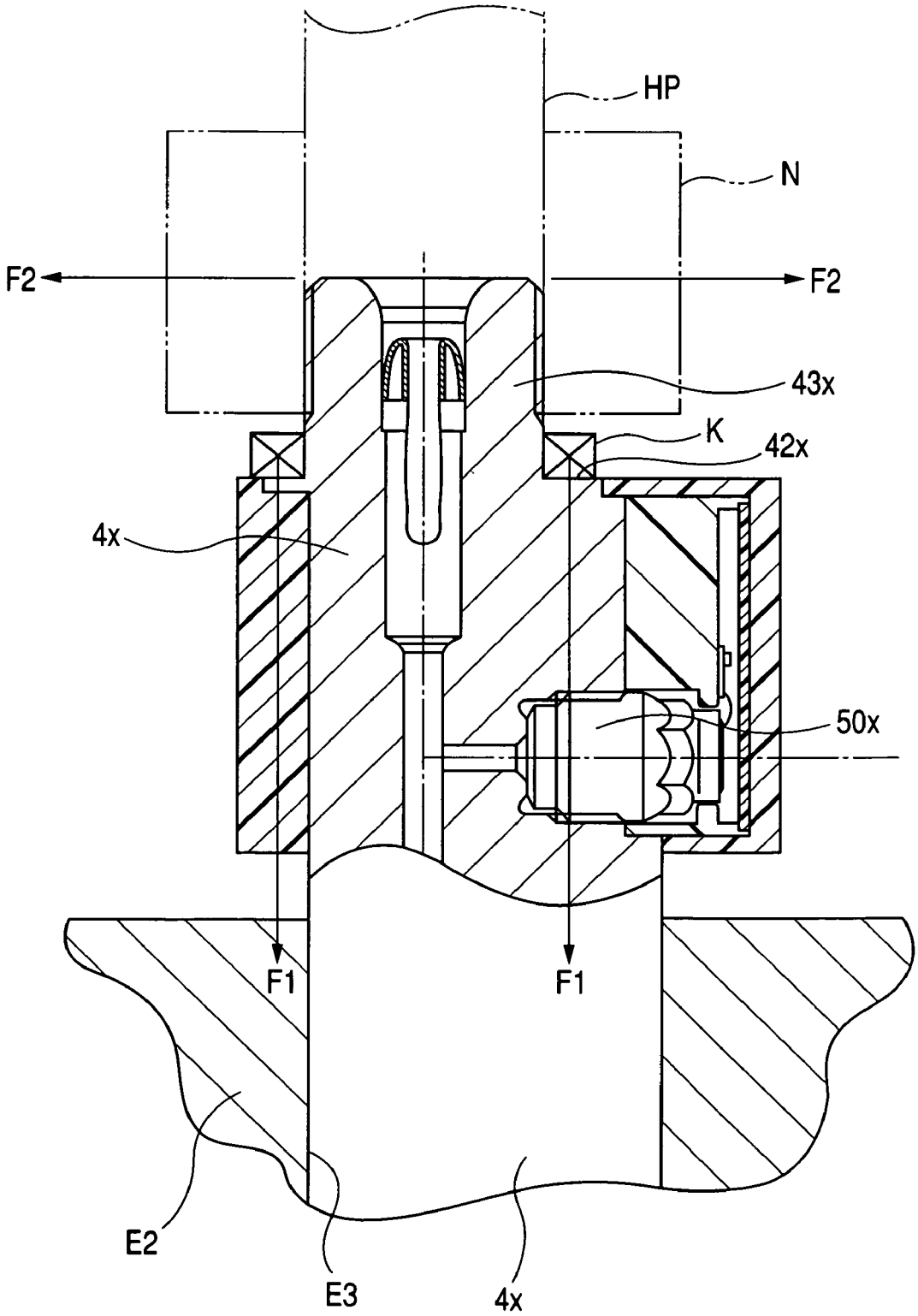
FIG. 4 (PRIOR ART)
FIG. 4 is a partially longitudinal sectional view which shows an internal structure of a conventional fuel injector.

5) The diaphragm 51*c* is located outside the mount recess 46 of the injector body 4, so that it will be insensitive to the thermal distortion of the injector body 4. This results in improved sensitivity of the diaphragm 51*c* to the pressure of the fuel supplied to the fuel injector. The location of the diaphragm 51*c* outside the mount recess 46 minimizes the adverse effects of the internal stress of the injector body 4 arising from externally applied forces, for example, the pressures F1 and F2, as illustrated in FIG. 4.

6) The stem 51 is made to be separate from the injector body 4, thus permitting it to be made of material at low costs whose coefficient of thermal expansion is small. This results in a decrease in thermal distortion of the stem 51 to ensure the accuracy of output from the stain gauge 52.

7) The mount surface 51*h* on which the strain gauge 52 is mounted is placed flush with the insulating substrate 53 on which the circuit component parts 54 are fabricated, thus facilitating ease of bonding the strain gauge 52 electrically to the circuit component parts 54 through the wires W.

8) The installation of the stem 51 in the injector body 4 is achieved by screwing the stem 51 to establish the engagement of the external thread 51*e* of the stem 51 with the internal thread of the injector body 4 to urge the sealing surface 51*g* into constant abutment with the sealing surface 46*a* of the injector body 4, thereby creating the metal-touch-seal between the stem 51 and the injector body 4 to avoid the intrusion of the fuel thereinto.

9) The high-pressure path 6 in the injector body 4 has the branch path 6*e* which diverges from the inlet (i.e., the high-pressure paths 6*b* and 6*c*) of the injector body 4, so that the fuel hardly flows or moves within the branch path 6*e* as compared with in the high-pressure paths 6*b* and 6*c*, thereby ensuring the accuracy in measuring the pressure of the fuel through the fuel pressure sensor 50 without been affected by the flow of the fuel entering the fuel injector, 10) The branch path 6*e* diverges from the high-pressure path 6, thus causing great stress to concentrate around the intersection between the paths 6*e* and 6*b*. An increase in intersections in the injector body 4 will result in an increase in stress concentrating within the injector body 4. In order to alleviate such a drawback, the branch path 6*e* is formed to extend in alignment with the high-pressure path 6*c* diverging from the inlet of the fuel ejector (i.e., the high-pressure path 6*b*) to minimize the intersections in the injector body 4.

Figure 3:
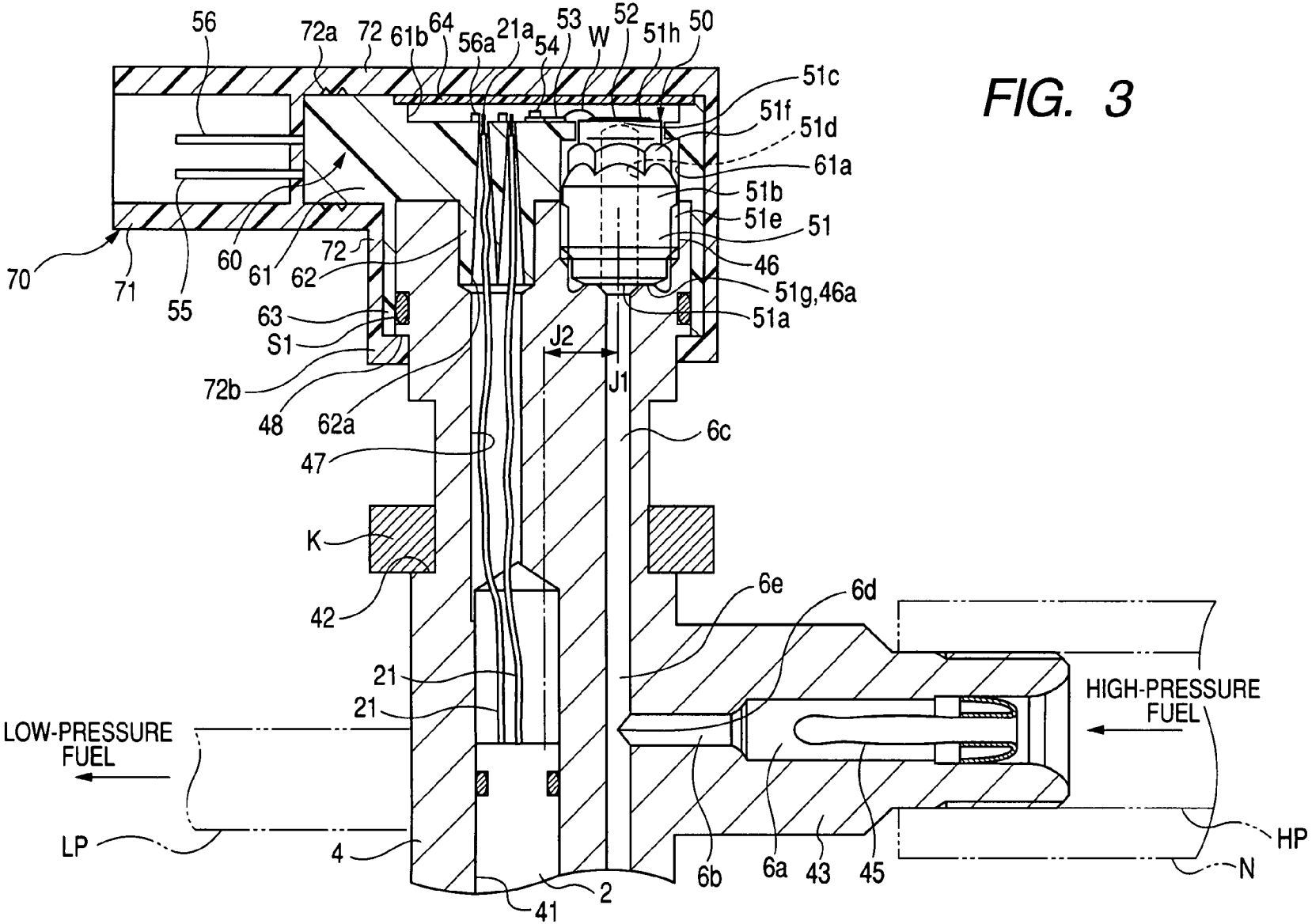
FIG. 3 is a partially longitudinal sectional view which shows an internal structure of a fuel injector according to the second embodiment of the invention.

FIG. 3 illustrates a fuel injector according to the second embodiment of the invention. The same reference numbers, as employed in the first embodiment, will refer to the same parts, and explanation thereof in detail will be omitted here.

The fuel injector is designed to have the high-pressure port 43 located closer to the spray hole 11 (i.e., the cylinder head E2) than the shoulder 42 (i.e., clamp k). In other words, the high-pressure port 43 to which the high-pressure pipe HP is to be joined is formed closer to the head of the fuel injector than where the pressure is exerted on the injector body 4 to mount it to the engine. The fuel injector may also be, as illustrated in FIG. 3, designed to have an outlet port (i.e., a drain port) to which the low-pressure pipe LP is to be joined and which is, like the high-pressure port 43, located closer to the spray hole 11 than the shoulder 42.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

The fuel injector may be designed to have a combination of the features as discussed above.

The fuel pressure sensor 50 may alternatively be installed in a portion of the injector body 4 which is retained inside the mount hole E3 of the cylinder head E2.

The clamp K, the high-pressure pipe HP is to be joined, and the low-pressure pipe LP may alternatively to joined to portions of the injector body 4 which are located inside the mount hole E3 of the cylinder head E2.

The fuel injector of the above embodiments may alternatively be designed to have the fuel pressure sensor 50 located far from at least one of the cylinder head E2 across the clamp K, the high-pressure pipe HP, and the low-pressure pipe LP.

The fuel pressure sensor 50 is installed from outside the injector body 4 in a direction of the longitudinal center line J2, but however, the installation may alternatively be achieved by forming the mount recess 46 in an outer circumferential wall of the injector body 4 and fitting the cylindrical body 51*b* of the stem 51 of the feel pressure sensor 50 in the mount recess 46 in a radius direction of the injector body 4.

The high-pressure pipe HP and the low-pressure pipe LP are joined to the injector body 4 from outside the circumferential wall thereof, but however, the fuel injector may alternatively be, as illustrated in FIG. 4, designed to have formed on an end of the injector body 4 an inlet and an outlet to which the high-pressure pipe HP and the low-pressure pipe LP are to be joined in the longitudinal direction of the injector body 4.

The resin mode 60 working as an thermal insulator to shield the circuit component parts 54 from the injector body 4 and the stem 51 may alternatively be made of rubber, ceramic material, or resin foam in order to improve the thermal resistance thereof.

The injector body 4 and the stem 51 are placed through the metal-touch seal, but however, they may alternatively be sealed hermetically using a gasket.

The sensor output terminal 55 and the drive terminals 56 may alternatively be disposed in a resin-molded holder separate from the resin mold 60. These two resin molds are preferably fit within the connector housing 70 in order to minimize the number of electric connectors used in the fuel injector.

The fuel pressure sensor 50 may alternatively be equipped with a piezoelectric device or another type of pressure sensitive device instead of the strain gauge 52.

The invention may be used with fuel injectors designed to inject the fuel into direct injection gasoline engines as well as those for diesel engines.

What is claimed is:

1. A fuel injector for an internal combustion engine comprising:

an injector body in which a fuel flow path is formed which extends from a fuel inlet to a spray hole, said injector body being adapted to be mounted in a cylinder head of an internal combustion engine;

an actuator disposed within said injector body, said actuator working to open the spray hole to spray fuel, as supplied to the fuel flow path through the fuel inlet, to the internal combustion engine; and a fuel pressure sensor working to measure a pressure of the fuel in said injector body and produce an electric signal indicative thereof, said fuel pressure sensor being installed in a first portion of said injector body which is located remote from the cylinder head of the internal combustion engine, on an opposite side of a second portion of said injector body with respect to the spray hole, whereby said second portion of said injector body is disposed between said fuel pressure sensor and said spray hole, wherein said second portion of said injector comprises:

a fuel inlet port of said injector body, on which a mechanical pressure is exerted when a high-pressure pipe is joined to the fuel inlet port to supply fuel to the fuel flow path;

a surface of said injector body on which a mechanical pressure is exerted by a clamp when the clamp is placed in abutment therewith to mount said injector body in a mount hole formed in the cylinder head; and a fuel outlet port of said injector body on which a mechanical pressure is exerted when a drain pipe is joined to the fuel outlet port to drain an excess of the fuel from said injector body.

2. A fuel injector as set forth in claim 1, wherein said injector body is so designed as to be mounted in the mount hole formed in the cylinder head of the internal combustion engine, and wherein the first portion of said injector body in which said fuel pressure sensor is installed is adapted to be located outside the mount hole.

3. An internal combustion engine having a cylinder head to which a fuel injector is mounted, the fuel injector comprising:

an injector body in which a fuel flow path is formed which extends from a fuel inlet to a spray hole, said injector body being mounted in the cylinder head;

an actuator disposed within said injector body, said actuator working to open the spray hole to spray fuel, as supplied to the fuel flow path through the fuel inlet; and a fuel pressure sensor working to measure a pressure of the fuel in said injector body and produce an electric signal indicative thereof, said fuel pressure sensor being installed in a first portion of said injector body which is located remote from the cylinder head, on an opposite side of a second portion of said injector body with respect to the spray hole, whereby said second portion of said injector body is disposed between said fuel pressure sensor and said spray hole, wherein said second portion of said injector comprises:

a fuel inlet port of said injector body, on which a mechanical pressure is exerted by a high-pressure pipe joined to the fuel inlet port to supply fuel to the fuel flow path;

a surface of said injector body on which a mechanical pressure is exerted by a clamp placed in abutment therewith to mount said injector body in a mount hole formed in the cylinder head; and a fuel outlet port of said injector body on which a mechanical pressure is exerted by a drain pipe joined to the fuel outlet port to drain an excess of the fuel from said injector body.

4. The internal combustion engine as set forth in claim 3, wherein the injector body is constructed and arranged so that when the injector body is mounted in the mount hole formed in the cylinder head of the internal combustion engine, the first portion of the injector body is located outside the mount hole.

5. The internal combustion engine as set forth in claim 3, wherein at least one of the clamp, the high-pressure pipe, and the drain pipe is mounted to the injector body outside the cylinder head of the engine.

6. The internal combustion engine as set forth in claim 3, wherein the fuel pressure sensor is disposed outside the cylinder head when the injector body is mounted to the cylinder head.

7. The internal combustion engine as set forth in claim 3, wherein the fuel outlet port is located on an opposite side of the clamp with respect to the spray hole of the injector.

8. The internal combustion engine as set forth in claim 3, wherein the fuel inlet port is located on an opposite side of the clamp with respect to the spray hole.

9. A fuel injector for an internal combustion engine comprising:

an injector body in which a fuel flow path is formed which extends from a fuel inlet to a spray hole, said injector body being adapted to be mounted in a cylinder head of an internal combustion engine;

an actuator disposed within said injector body, said actuator working to open the spray hole to spray fuel, as supplied to the fuel flow path through the fuel inlet, to the internal combustion engine; and a fuel pressure sensor working to measure a pressure of the fuel in said injector body and produce an electric signal indicative thereof, said fuel pressure sensor being installed in a first portion of said injector body which is located remote from the spray hole, on an opposite side of a second portion of said injector body with respect to the spray hole, whereby said second portion of said injector body is disposed between said fuel pressure sensor and said spray hole, wherein said second portion of said injector comprises at least one of:

a fuel inlet port of said injector body, on which a mechanical pressure is exerted when a high-pressure pipe is joined to the fuel inlet port to supply fuel to the fuel flow path;

a surface of said injector body on which a mechanical pressure is exerted by a clamp when the clamp is placed in abutment therewith to mount said injector body in a mount hole formed in the cylinder head; and a fuel outlet port of said injector body on which a mechanical pressure is exerted when a drain pipe is joined to the fuel outlet port to drain an excess of the fuel from said injector body.

10. A fuel injector as set forth in claim 9, wherein the injector body is constructed and arranged so that when the injector body is mounted in the mount hole formed in the cylinder head of the internal combustion engine, the first portion of the injector body is located outside the mount hole.

11. A fuel injector as set forth in claim 9, wherein the injector body is constructed and arranged so that when the injector body is mounted in the mount hole formed in the cylinder head of the internal combustion engine, at least one of said fuel inlet port, said surface of said injector body, and said fuel outlet port is located outside the mount hole.

12. A fuel injector as set forth in claim 9, wherein the injector body is constructed and arranged so that when the injector body is mounted in the mount hole formed in the cylinder head of the internal combustion engine, the fuel pressure sensor is located outside the mount hole.

13. A fuel injector as set forth in claim 9, wherein the fuel outlet port is located on an opposite side of said surface of said injector body with respect to the spray hole of the injector.

14. A fuel injector as set forth in claim 9, wherein the fuel inlet port is located on an opposite side of said surface of said injector body with respect to the spray hole of the injector.

15. A fuel injector as set forth in claim 9, wherein the fuel inlet port of the injector body is disposed between the fuel pressure sensor and said spray hole.

16. A fuel injector as set forth in claim 9, wherein said fuel inlet port extends in a direction perpendicular to a longitudinal axis of said injector body.

* * * * *